US008648675B1

(12) United States Patent
Podell

(10) Patent No.: US 8,648,675 B1
(45) Date of Patent: Feb. 11, 2014

(54) TRANSMISSION-LINE BEND STRUCTURE

(71) Applicant: Werlatone, Inc., Brewster, NY (US)

(72) Inventor: Allen F. Podell, Palo Alto, CA (US)

(73) Assignee: Werlatone, Inc., Patterson, NY (US)

( * ) Notice: Subject to any disclaimer, the term of this patent is extended or adjusted under 35 U.S.C. 154(b) by 0 days.

(21) Appl. No.: 13/691,325

(22) Filed: Nov. 30, 2012

(51) Int. Cl.
*H01P 3/08* (2006.01)

(52) U.S. Cl.
USPC ..... 333/246; 333/116

(58) Field of Classification Search
USPC ..... 333/33, 116, 246
See application file for complete search history.

(56) References Cited

U.S. PATENT DOCUMENTS 2,530,064 A 11/1950 Jones
3,375,511 A 3/1968 Trimble et al.
6,642,819 B1 11/2003 Jain et al.
6,972,639 B2 * 12/2005 Podell ..... 333/112
7,132,906 B2 11/2006 Podell
7,190,240 B2 3/2007 Podell
7,245,192 B2 7/2007 Podell
7,990,237 B2 8/2011 Margomenos et al.
2005/0146394 A1 * 7/2005 Podell ..... 333/116

* cited by examiner

*Primary Examiner* — Benny Lee
*Assistant Examiner* — Rakesh Patel
(74) *Attorney, Agent, or Firm* — Kolisch Hartwell, PC

(57) ABSTRACT

A planar transmission line may include first and second spaced apart planar conductors. The transmission line may include a first section in which the first and second conductors extend along a first line in respective first and second parallel planes and are broadside coupled, and a second section extending from the first section along a second line transverse to the first line. The first and second conductors in the second section may include respective first portions extending in the respective first and second planes that are broadside coupled. The first conductor may include a second portion in the second section extending in the second plane, with the first portion of the second conductor and the second portion of the first conductor having adjacent edges that are edge-coupled.

20 Claims, 6 Drawing Sheets

TRANSMISSION-LINE BEND STRUCTURE

TECHNICAL FIELD

This disclosure relates to transmission lines, and more particularly transmission-line bend structures.

BACKGROUND

Two conductive lines are coupled when they are spaced apart, but spaced closely enough together for energy flowing in one to be induced in the other. The amount of energy flowing between the lines is related to the dielectric medium the conductors are in and the spacing between the lines. Even though electromagnetic fields surrounding the lines are theoretically infinite, lines are often referred to as being closely or tightly coupled, loosely coupled, or uncoupled, based on the relative amount of coupling.

Parallel transmission lines couple both electrically and magnetically. The coupling is inherently proportional to frequency, and the directivity can be high if the magnetic and electric couplings are equal.

For edge coupling between two planar conductors, it may be sufficient that the conductors have facing edges, and for broadside coupling, it may be sufficient that the conductors have facing broad surfaces. Two faces may be considered facing, for instance, if a line can be drawn directly between them. Correspondingly, two faces may be considered overlapping if a line normal to the face of one conductor intersects a face of another. Surfaces may thus be facing each other without being overlapping or directly opposite each other.

BRIEF SUMMARY

In some examples, a planar transmission line may include first and second spaced apart planar conductors. The transmission line may include a first section in which the first and second conductors extend along a first line in respective first and second parallel planes and are broadside coupled, and a second section extending from the first section along a second line transverse to the first line. The first and second conductors in the second section may include respective first portions extending in the respective first and second planes that are broadside coupled. The first conductor may include a second portion in the second section extending in the second plane, with the first portion of the second conductor and the second portion of the first conductor having adjacent edges that are edge-coupled.

DETAILED DESCRIPTION

Figure 1:
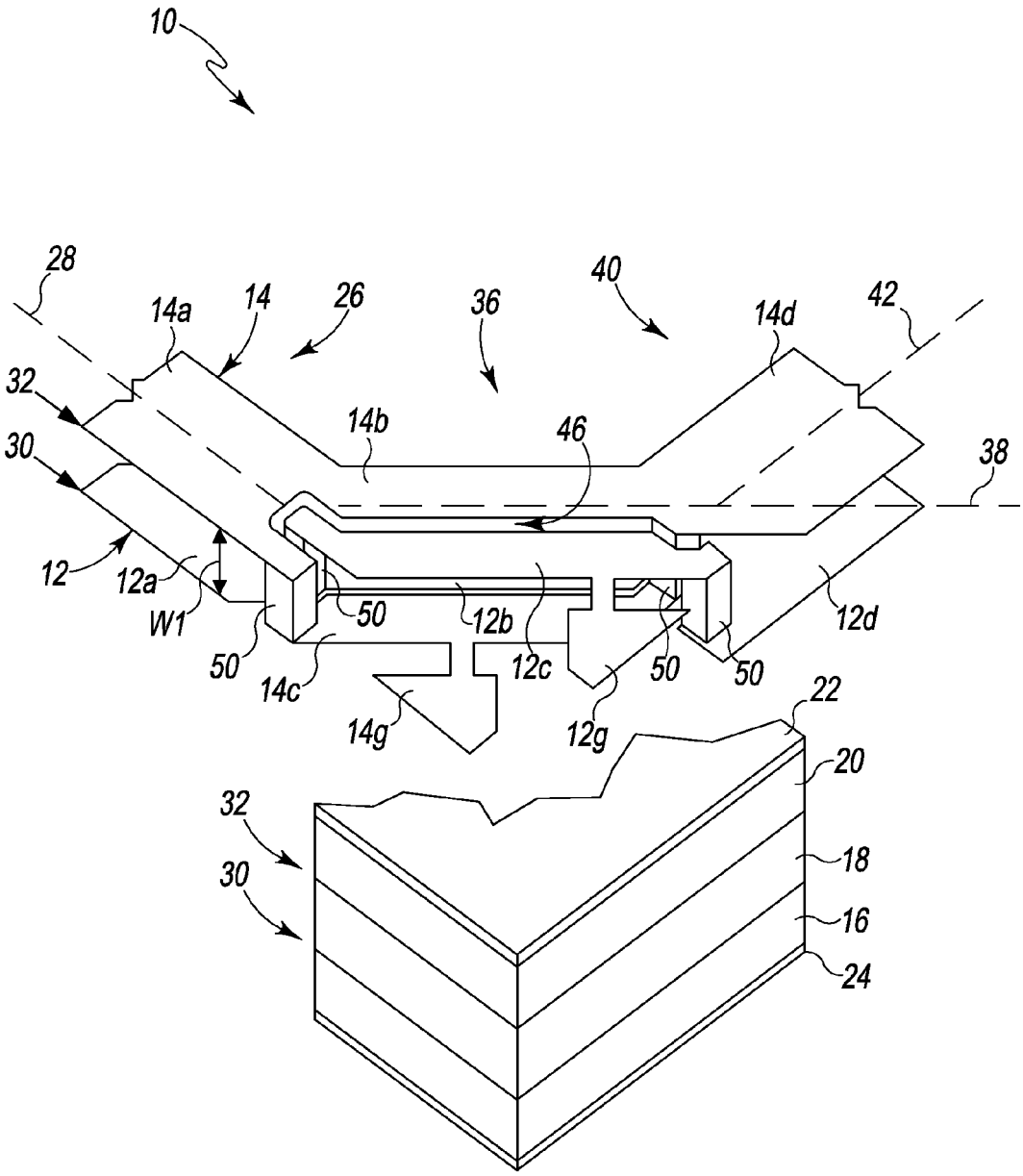
FIG. 1 is a simplified isometric illustration of an example of a planar transmission line and associated substrate cross-section.
Figure 2:
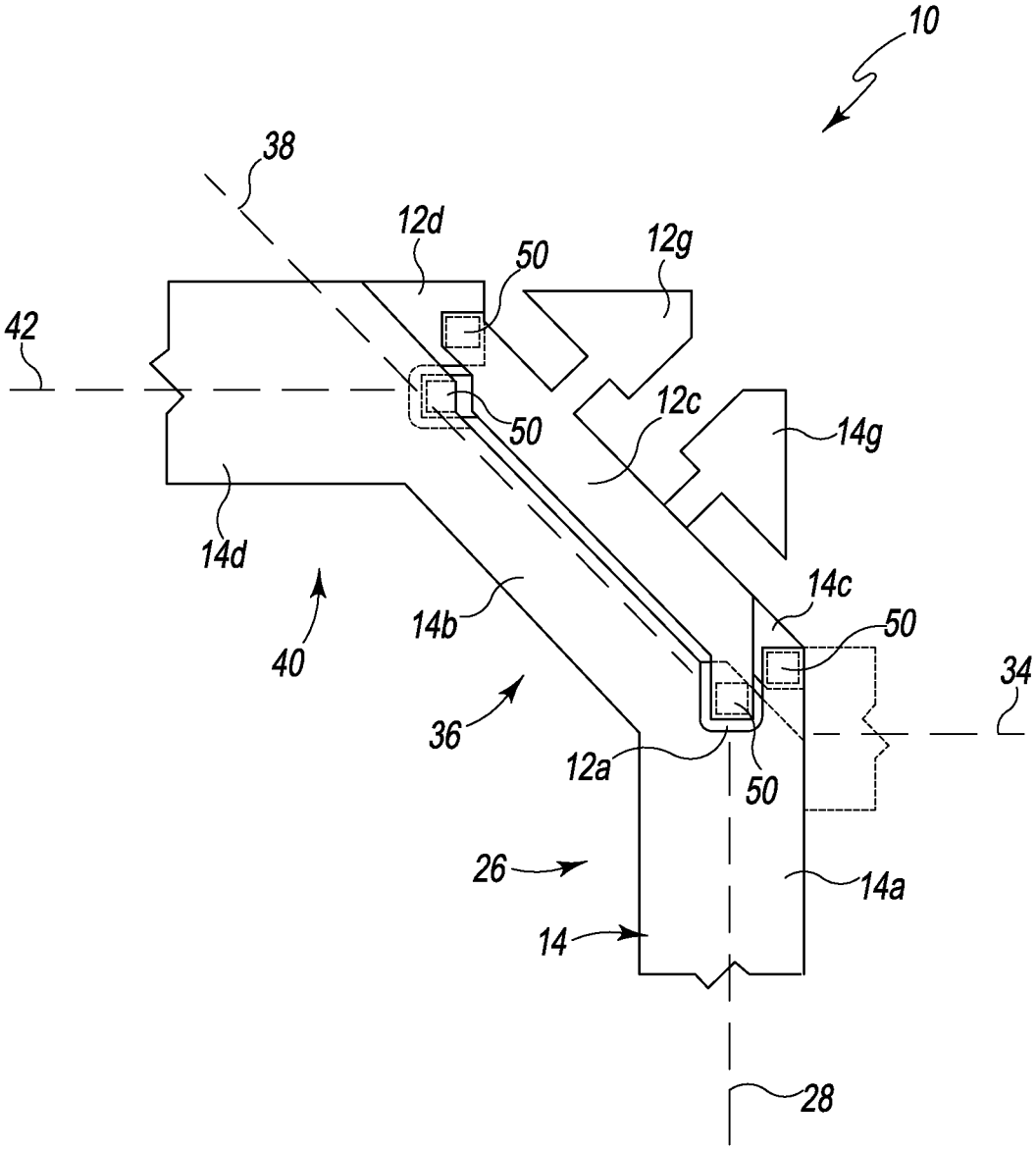
FIG. 2 is a plan view of the assembly of FIG. 1.

FIGS. 1-4 depict an example of a planar transmission line 10, which may include a first planar conductor 12, a second planar conductor 14, dielectric substrates 16, 18, 20, and conductive layers 22 and 24. Conductive layers 22 and 24 may be ground planes, which, with conductors 12 and 14, form the planar transmission line 10. The first planar conductor 12 may be spaced apart from the second planar conductor 14 by a separation width W1 suitable for inductive and capacitive coupling between the conductors, which width may also be the thickness of the dielectric substrate 18 separating the two conductors.

The planar transmission line 10 may include a first section 26 in which the first planar conductor 12 and the second planar conductor 14 extend along a first line 28 as viewed normal to the planes of the conductors. In section 26, conductor 12 is disposed in a first plane 30 defined by the junction between dielectric substrates 16 and 18. Similarly, conductor 14 is disposed in a second plane 32 defined by the junction between dielectric substrates 18 and 20. These planes may correspond to dielectric surfaces, where appropriate for support of the conductors, such as surfaces of the dielectric substrates. Alternatively, one or both of the conductors 12 and 14 may extend along an alternative line, such as a line 34 shown in FIG. 2, in their respective planes 30 and 32 (shown in FIG. 1).

In the first section 26, the first planar conductor 12 may have a conductor portion 12*a* having a broad surface facing a broad surface of a conductor portion 14*a* of the second planar conductor 14 spaced apart by the separation width W1 such that the first planar conductor 12 and the second planar conductor 14 may be broadside coupled. Two faces may be considered facing, for instance, if a line can be drawn directly between them. Correspondingly, two faces may be considered overlapping if a line normal to the face of one conductor intersects a face of another. Surfaces may thus be facing each other without being overlapping or directly opposite each other. The conductor portion 12*a* may be facing, overlapping, or completely overlapping the conductor portion 14*a* in order to provide the desired amount of broadside coupling. Optionally, the broad surfaces may be only partially overlapping or not overlapping at all.

As shown in FIGS. 1-4, the planar transmission line 10 may include a second section 36 in which the first planar conductor 12 and the second planar conductor 14 extend along a second line 38. The second line 38 may be transverse to the first line 28. In this example, the second line is at a 45-degree angle to the first line 28, but other relative angles may be used as appropriate in a particular application. In the second section 36, the first planar conductor 12 and the second planar conductor 14 may include respective first conductor portions 12*b* and 14*b* with respective broad surfaces extending in the respective first and second planes 30 and 32. Conductor portions 12*b* and 14*b* may be broadside coupled. The broad surface of conductor portion 12*b* may be facing, overlapping, or completely overlapping the broad surface of conductor portion 14*b*, as shown, in order to provide the desired amount of broadside coupling. Optionally, the broad surfaces may be only partially overlapping or not overlapping at all.

A broad surface of a second conductor portion 12*c* of the first planar conductor 12 may extend in the second plane 32 and may be broadside coupled to a broad surface of a second conductor portion 14*c* of the second planar conductor 14, which may extend in the first plane 30. The broad surface of conductor portion 12*c* may be facing, overlapping, or completely overlapping the broad surface of conductor portion 14*c* in order to provide the desired amount of broadside coupling. Optionally, the broad surfaces may be only partially overlapping or not overlapping at all.

The planar transmission line 10 may also include a third section 40, with the second section 36 connected between the first section 26 and the third section 40. In the third section, the first planar conductor 12 and the second planar conductor 14 extend along a third line 42. The third line 42 may be transverse to the second line 38, as shown. The first and third lines may be parallel, as is the case for lines 34 and 42 (see FIG. 2), or transverse depending on the configuration of the transmission line. In this example, first and third lines are perpendicular to each other, with sections 26, 36, and 40 of the transmission line forming a 90-degree corner or bend.

In the third section 40, a conductor portion 12*d* of the first planar conductor 12 may extend in the first plane 30 and a conductor portion 14*d* of the second planar conductor 14 may extend in the second plane 32, such that a broad surface of the conductor portion 12*d* and a broad surface of the conductor portion 14*d* may be broadside coupled. The broad surfaces may be facing, overlapping, or completely overlapping in order to provide the desired amount of broadside coupling. Optionally, the broad surfaces may be only partially overlapping or not overlapping at all.

Figure 3:
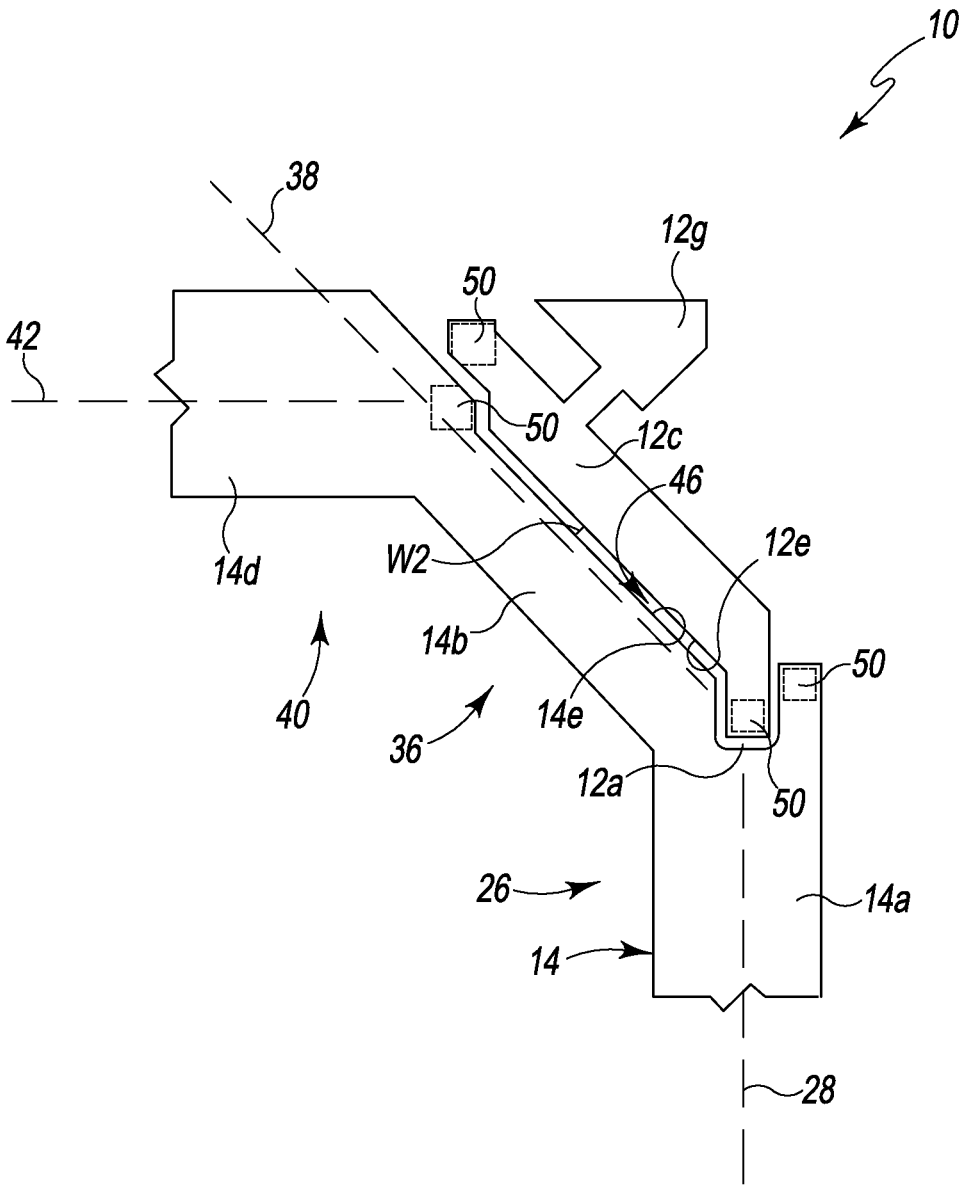
FIG. 3 is a plan view of conductors on a first plane of the planar transmission line of FIG. 2.

FIG. 3 is a plan view of the portions of conductors 12 and 14 lying in the second plane 32 of the planar transmission line 10 of FIG. 1. The conductor portion 14*b* may have an adjacent edge 14*e* and the conductor portion 12*c* may have an adjacent edge 12*e*. Adjacent edge 14*e* may face adjacent edge 12*e* and may define a gap 46 having a width W2. Gap 46 may be sufficiently narrow to provide edge coupling between the conductor portions so that the conductor portions 14*b* and 12*c* may be edge-coupled. The width W2 may remain constant or may vary.

Figure 4:
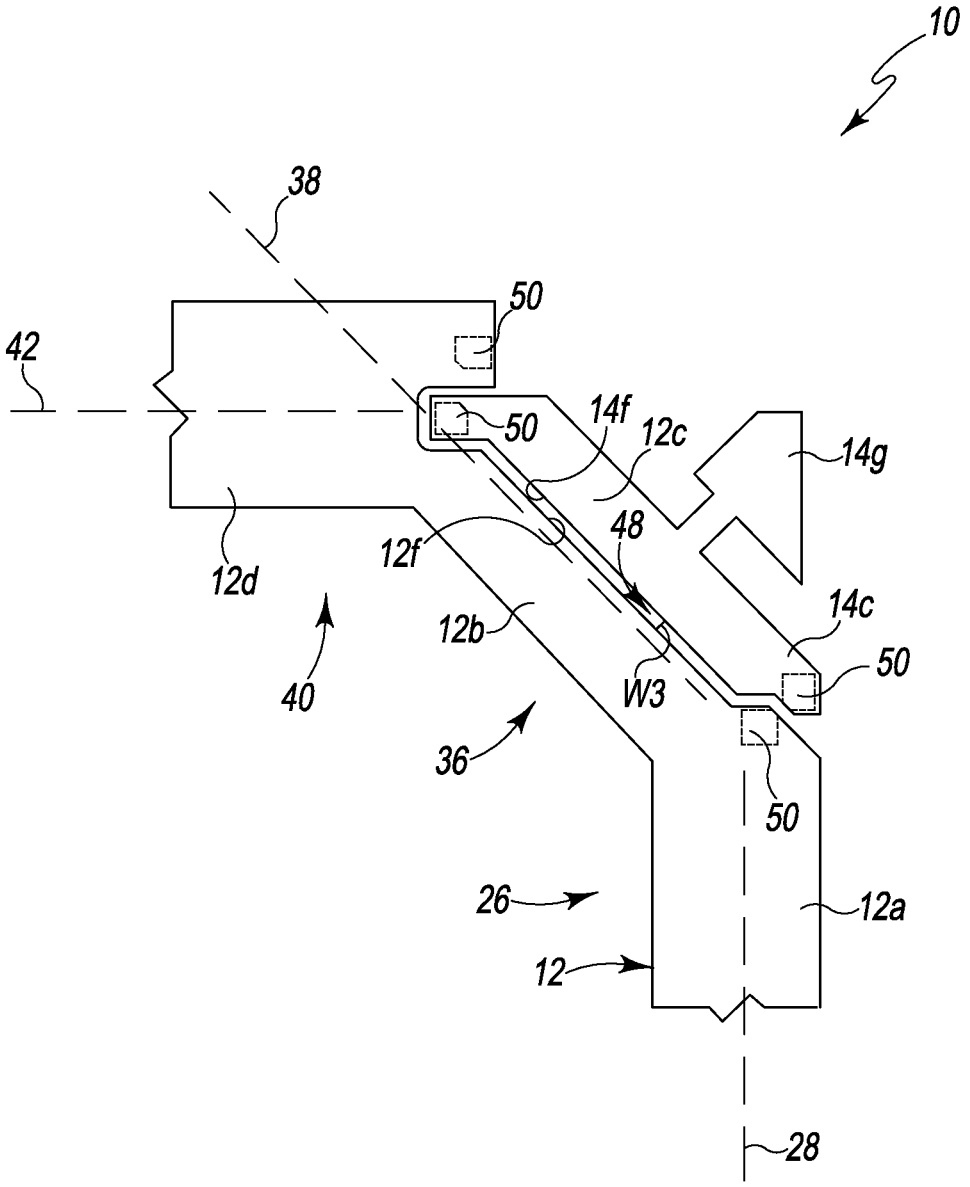
FIG. 4 is a plan view of conductors on a second plane of the planar transmission line of FIG. 2.

FIG. 4 is a plan view of the portions of conductors 12 and 14 lying in the first plane 30 of the planar transmission line 10 of FIG. 1. In the second section 36, the conductor portion 14*c* is coplanar with the conductor portion 12*b*. The conductor portion 12*b* and the conductor portion 14*c* conductor may have respective adjacent edges 12*f* and 14*f*. Adjacent edges 12*f* and 14*f* may define a gap 48, having a width W3, which may be sufficiently narrow to provide edge coupling. The width W3 may remain constant or may vary.

As shown in FIGS. 1-4, the conductors may further include interconnects, such as vias 50, that interconnect conductor portions on different planes. More specifically, vias may interconnect the ends of the conductor portion 14*c* with the conductor portions 14*a* and 14*d* in the first and third sections, respectively. Similarly, vias may interconnect the ends of the conductor portion 12*c* with the conductor portions 12*a* and 12*d* in the first and third sections, respectively.

Other forms of coupling may also be provided in the planar transmission line 10. For example, there may be conductor portions that provide increased capacitive coupling with the ground planes 22 and 24. In this example, conductive flags 12*g* and 14*g* laterally extend from conductor portions 12*c* and 14*c*. In this example, flags 12*g* and 14*g* do not overlap with each other but rather are attached to different positions of the conductor portions they extend from so that they have little if any broadside coupling between them and couple primarily to the ground planes 22 and 24, respectively.

The planar transmission line 10 may also include multiple conductor portions of the conductors 12 and 14 in the second section 36 so that the two conductors alternate laterally across the section. Each of these additional conductor portions may have adjacent edges configured in such a way as to define additional gaps with widths that are sufficiently narrow to provide edge coupling between the conductor portions. In other words, in addition to the conductor portions 12*b*, 12*c*, 14*b*, and 14*c* extending along section 36 as shown in FIG. 1, the planar transmission line 10 may also or may alternatively have at least one additional length of the conductor 12 and/or conductor 14 extending along the section to provide additional edge coupling between the conductors in the bend.

Figure 5:
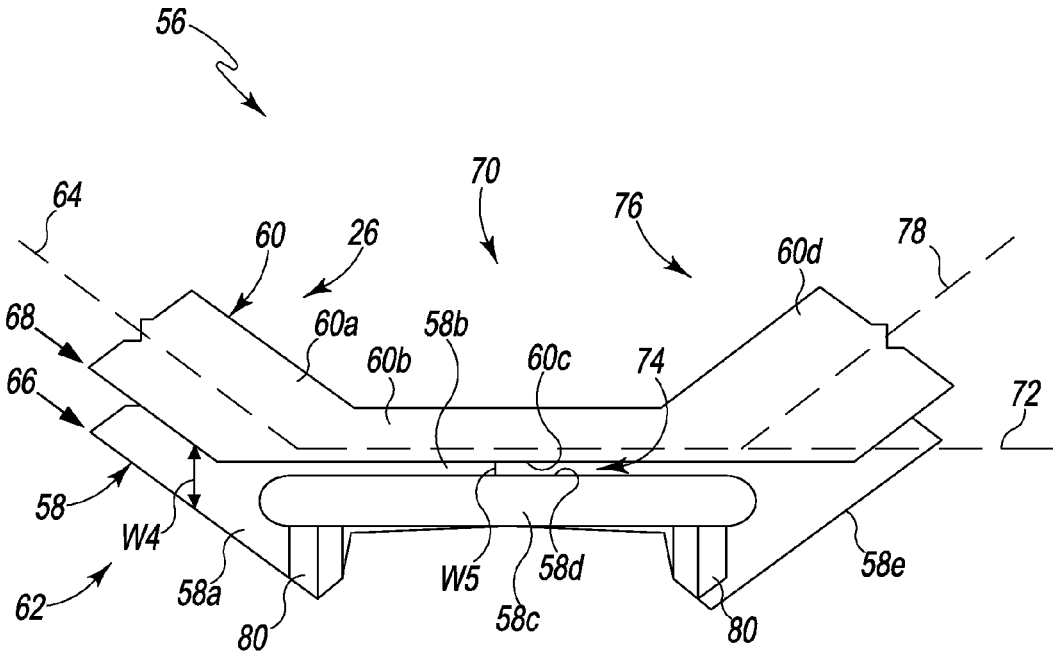
FIG. 5 is a simplified isometric illustration of another embodiment of a planar transmission line.

FIG. 5 depicts another embodiment of a planar transmission line, shown generally at 56. Transmission line 56 includes first and second planar conductors 58 and 60. In a first section 62 of the transmission line, the first planar conductor 58 may be spaced apart from the second planar conductor 60 by a separation width W4. The first planar conductor 58 and the second planar conductor 60 extend along a first line 64 in a first plane 66 and a second plane 68, respectively, in section 62. These planes may correspond to dielectric surfaces, where appropriate for support of the conductors, such as surfaces of a dielectric substrate or substrates, as described for transmission line 10. The first plane 66 and the second plane 68 may be parallel.

In the first section 62, the first planar conductor 58 may have a first conductor portion 58*a* with a broad surface facing a broad surface of a corresponding first conductor portion 60*a* of the second planar conductor 60 spaced apart by the separation width W4 such that these conductor portions may be broadside coupled. The broad surface of conductor portion 58*a* may be facing, partially overlapping, or completely overlapping the broad surface of conductor portion 60*a* in order to provide the desired amount of broadside coupling.

The planar transmission line 56 may include a second section 70 in which the first planar conductor 58 and the second planar conductor 60 have respective conductor portions 58*b* and 60*b* that extend along a second line 72 and are spaced apart by the separation width W4. The second line 72 may be transverse to the first line 64. In the second section 70, the first planar conductor portions 58*b* and 60*b* may have respective broad surfaces extending in the respective first and second planes 66 and 68. In this example, conductor portions 58*a* and 58*b* directly overlap with conductor portions 60*a* and 60*b*, resulting in the conductors 58 and 60 being broadside coupled.

In the second section 70, the conductor 58 may include a third conductor portion 58*c* extending in the second plane 68. The conductor portion 60*b* may have an adjacent edge 60*c* and the conductor portion 58*c* may have an adjacent edge 58*d*. The adjacent edges 58*d* and 60*c* may define a gap 74, having a respective width W5, which is sufficiently narrow to provide edge coupling between the conductor portions 58*c* and 60*b*.

The planar transmission line 56 may also include a third section 76, with the second section 70 connected between the first section 62 and the third section 76. In the third section, a conductor portion 58*e* of the conductor 58 and a conductor portion 60*d* of conductor 60 extend along a third line 78. The third line 78 may be transverse to the second line 72. In the third section, the conductor portion 58*e* may extend in the first plane 66 and the conductor portion 60*d* may extend in the second plane 68, such that a broad surface of conductor portion 58*e* and a broad surface of the conductor portion 60*d* may be broadside coupled. The broad surface of conductor portion 58*e* may be facing, overlapping, or completely overlapping the broad surface of conductor portion 60*d* in order to provide the desired amount of broadside coupling. Optionally, the broad surfaces may be only partially overlapping or not overlapping at all.

The conductors may further include interconnects, such as vias 80, that interconnect conductor portions on different planes. More specifically, vias may interconnect the conductor portions 58*a* and 58*e* with respective ends of the conductor portion 58*c*.

Other forms of coupling may also be provided in planar transmission line 56. For example, there may be conductive extensions (not shown), similar to flags 12*g* and 14*g*, which laterally extend from and are part of conductors 58 and 60.

The planar transmission line 56 may also include multiple portions of the conductors 58 and 60 in the second section 70. Each of these additional portions may have adjacent edges configured in such a way as to define additional gaps with widths that may be sufficiently narrow to edge couple the adjacent conductor portions. In other words, in addition to the second portion 58*c* extending around the outside of the corner section as shown in FIG. 5, the planar transmission line 56 may also or may alternatively have at one or more additional portions of conductors 58 and/or 60 extending along upper or lower, intermediate or inside portions of the corner section, so as to provide additional edge coupling.

Figure 6:
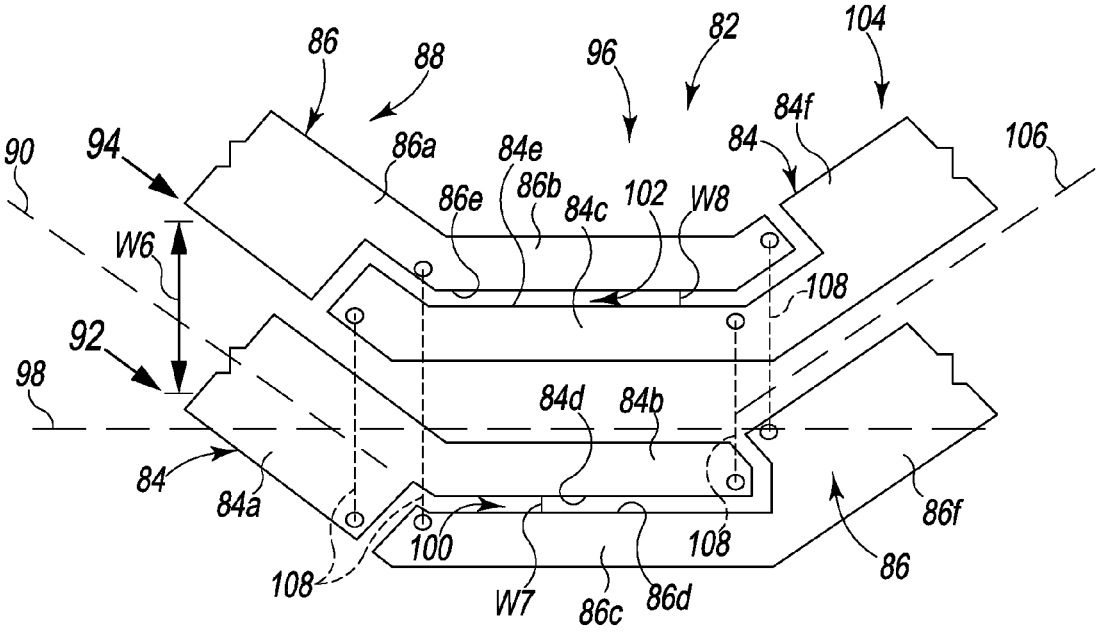
FIG. 6 is a simplified isometric illustration of another embodiment of a planar transmission line.

FIG. 6 depicts a simplified example of another embodiment of a planar transmission line, shown generally at 82. Transmission line 82 includes first and second planar conductors 84 and 86. The first planar conductor 84 may be spaced apart from the second planar conductor 86 by a separation width W6. The planar transmission line 82 may include a first section, shown generally at 88, in which the first planar conductor 84 and the second planar conductor 86 extend along a first line 90 as viewed normal to the planes of the conductors in a first plane 92 and a second plane 94, respectively. These planes may correspond to dielectric surfaces, where appropriate for support of the conductors, such as surfaces of a dielectric substrate or substrates, as described for transmission line 10. As shown, the first plane 92 and the second plane 94 may be parallel.

In the first section 88, the first planar conductor 84 may have a first conductor portion 84*a* with a broad surface facing a broad surface of a corresponding first conductor portion 86*a* of the second planar conductor 86 spaced apart by a separation width W6 such that the first planar conductor 84 and the second planar conductor 86 may be broadside coupled. The broad surface of conductor portion 84*a* may be facing, overlapping, or completely overlapping the broad surface of conductor portion 86*a* in order to provide the desired amount of broadside coupling.

The planar transmission line 82 may include a second section 96 extending along a second line 98 in which the first planar conductor 84 may have a second conductor portion 84*b* extending in the first plane 92 and a third conductor portion 84*c* extending in the second plane 94. Similarly, the second planar conductor 86 may have a second conductor portion 86*b* extending in the second plane 94 and a third conductor portion 86*c* extending in the first plane 92. As shown, the second line 98 may be transverse to the first line 90.

In the second section 96, a broad surface of the second conductor portion 84*b* may be facing a broad surface of the corresponding second conductor portion 86*b*. Additionally, a broad surface of the third conductor portion 84*c* may be facing a broad surface of the corresponding third portion 86*c*. The second conductor portions 84*b* and 86*b*, as well as the third conductor portions 84*c* and 86*c*, may be spaced apart by a separation width W6, such that the respective conductor portions of the first planar conductor 84 and the second planar conductor 86 may be broadside coupled. The broad surfaces of second and third conductor portions 84*b* and 84*c* may be respectively facing, overlapping, or completely overlapping the broad surfaces of second and third conductor portions 86*b* and 86*c* in order to provide the desired amount of broadside coupling.

In the second section 96, there may also be edge coupling. An edge 84*d* of the conductor portion 84*b* and an adjacent edge 86*d* of the conductor portion 86*c* may define a gap 100. The gap 100 may have a width W7 that may be sufficiently narrow as to provide edge side coupling between the conductor portions, so that the first planar conductor 84 and the second planar conductor 86 may be edge-coupled. The width W7 may vary or remain constant. Furthermore, an adjacent edge 86*e* of the conductor portion 86*b* and an adjacent edge 84*e* of the conductor portion 84*c* may define a gap 102. The gap 102 may have a width W8 that is sufficiently narrow as to provide edge side coupling between the conductor portions, so that the second planar conductor 86 and the first planar conductor 84 may be edge-coupled. The width W8 may vary or remain constant. The widths W7 and W8 may be equal.

The planar transmission line 82 may also include a third section 104 with the second section 96 connected between the first section 88 and the third section 104. In the third section 104, a fourth conductor portion 84*f* of the first planar conductor 84 and a fourth conductor portion 86*f* of the second planar conductor 86 extend along a third line 106 as viewed normal to the planes of the conductors. The third line 106 may be transverse to the second line 98. The fourth conductor portion 84*f* may extend in the second plane 94 and the fourth conductor portion 86*f* may extend in the first plane 92.

The conductor portion 84*f* may be spaced apart from the conductor portion 86*f* by the separation width W6, such that the broad surfaces of the conductor portions 84*f* and 86*f* may be broadside coupled. In this example, conductor portion 84*f* directly overlaps with conductor portion 86*f*, resulting in the conductors 84 and 86 being broadside coupled. The broad surface of the conductor portion 84*f* may be facing, overlapping, or completely overlapping the broad surface of the conductor portion 86*f* in order to provide the desired amount of broadside coupling. Optionally, the broad surfaces may be only partially overlapping or not overlapping at all.

The conductors may further include interconnects, such as vias 108, represented generally by dashed lines, that interconnect conductor portions on different planes. More specifically, vias may interconnect the first and second conductor portions 84*a* and 84*b* with the third and fourth conductor portions 84*c* and 84*f*, and may interconnect the first and second conductor portions 86*a* and 86*b* with the third and fourth conductor portions 86*c* and 86*f*.

Other forms of coupling may also be provided in planar transmission line 82. For example, there may be conductive extensions (not shown), similar to flags 12*g* and 14*g*, which laterally extend from and are part of conductors 84 and 86.

Figure 7:
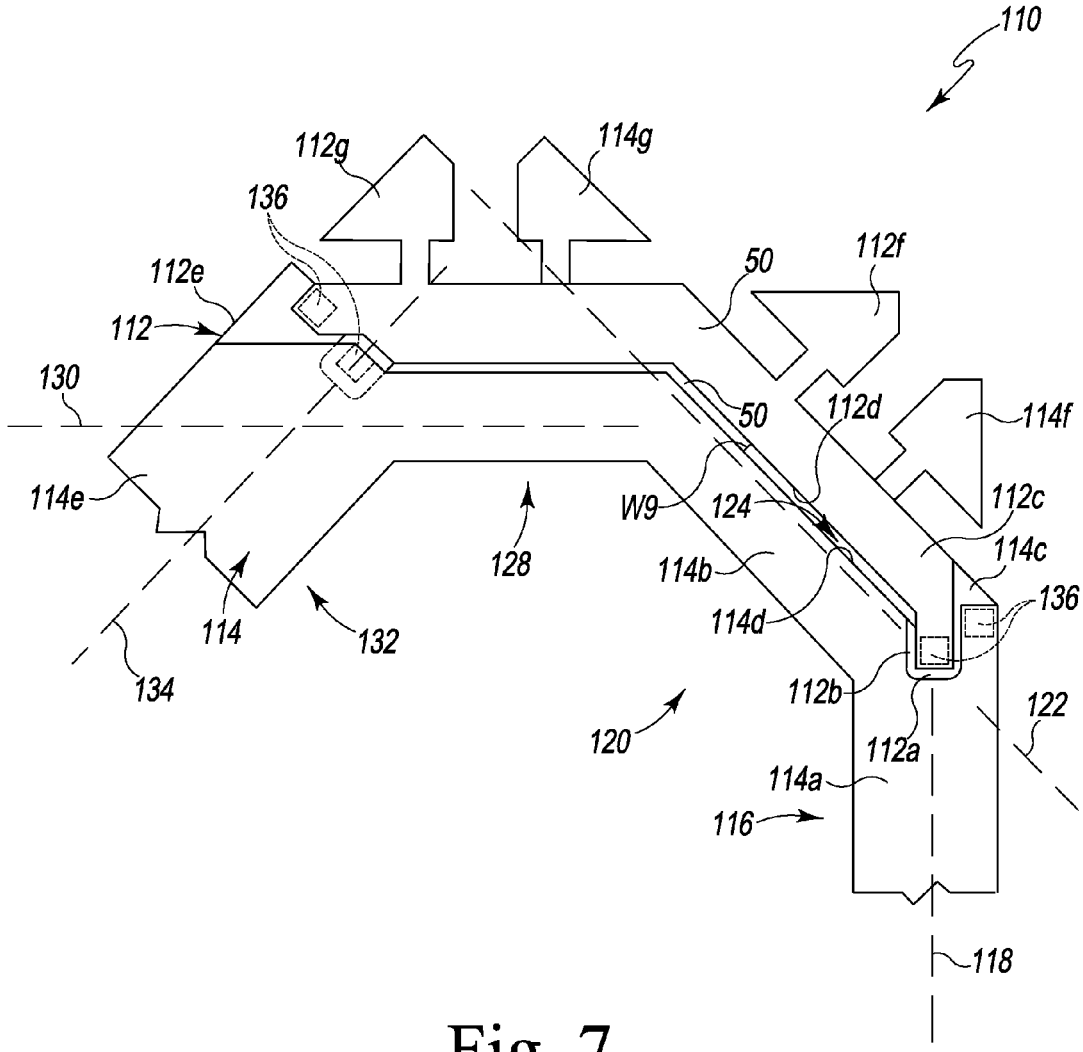
FIG. 7 is a plan view of another embodiment of a planar transmission line.

FIG. 7 depicts another embodiment of a planar transmission line, shown generally at 110. The planar transmission line 110 may include a first planar conductor 112 and a second planar conductor 114, which may be spaced apart by a separation width suitable for inductive and capacitive coupling between the conductors in a configuration similar to the planar transmission line 10 of FIGS. 1-4. The separation width may be the thickness of a dielectric substrate separating the two conductors. Transmission line 110 is similar in structure to transmission line 10 except that transmission line 110 bends around a larger angle having two intermediate sections each with edge coupling, instead of one intermediate section.

The planar transmission line 110 may include a first section 116 in which the first planar conductor 112 and the second planar conductor 114 extend along a first line 118 as viewed normal to the planes of the conductors. In the first section 116, similar to the configuration of transmission line 10 shown in FIGS. 1-4, the first planar conductor 112 may be disposed in a first plane defined by a first junction between dielectric substrates and the second planar conductor 114 may be disposed in a second plane defined by a second junction between dielectric substrates. These planes may correspond to surfaces of the dielectric substrates where appropriate.

In the first section 116, the first planar conductor 112 may have a conductor portion 112*a* having a broad surface facing a broad surface of a conductor portion 114*a* of the second planar conductor 114 spaced apart by a separation width such that the conductors 112 and 114 may be broadside coupled. The broad surface of conductor portion 112*a* may be facing, overlapping, or completely overlapping the broad surface of the conductor portion 114*a* in order to provide the desired amount of broadside coupling.

The planar transmission line 110 may include a second section 120 in which the first planar conductor 112 and the second planar conductor 114 extend along a second line 122. The second line 122 may be transverse to the first line 118, as shown. In the second section 120, the first planar conductor 112 and the second planar conductor 114 may include respective conductor portions 112*b* and 114*b* with respective broad surfaces extending in the respective first and second planes spaced apart by a separation width so that the conductor portions 112*b* and 114*b* of the conductors may be broadside coupled. The broad surfaces of the conductor portions 112*b* and 114*b* may be facing, overlapping, or completely overlapping in order to provide the desired amount of broadside coupling.

Similar to the transmission line 10 of FIGS. 1-4, in the second section 120, the conductor 112 may have a second conductor portion 112*c* extending in the second plane along the second line 122, and the conductor 114 may have a second conductor portion 114*c* extending in the first plane along the second line 122 as viewed normal to the planes of the conductors. A broad surface of the second conductor portion 112*c* may be spaced apart from a corresponding broad surface of the second conductor portion 114*c* so as to be broadside coupled. The broad surfaces of the second conductor portions 112*c* and 114*c* may be facing, overlapping, or completely overlapping in order to provide the desired amount of broadside coupling.

In the second section 120, the first conductor portion 114*b* may have an edge 114*d* and the second conductor portion 112*c* may have an adjacent edge 112*d*. Edge 114*d* may face adjacent edge 112*d* and these edges together may define a gap 124, having a width W9. Width W9 may be sufficiently narrow to provide edge coupling and may remain constant or may vary.

Similar to the transmission line 10 as shown in FIGS. 1-4, in the second section 120, the second portion 114*c* may have an edge that is facing an adjacent edge 112 of conductor portion 112*b*, which edges are generally hidden in the figure. These edges may define a gap like gap 124 having a width that is sufficiently narrow to provide edge coupling. This width may be equivalent to the width W9.

The planar transmission line 110 may also include a third section 128, with the second section 120 connected between the first section 116 and the third section 128. In the third section 128, the first and second conductor portions 112*b* and 112*c* and the first and second conductor portions 114*b* and 114*c* have a bend and extend along a third line 130 as viewed normal to the planes of the conductors. The third line 130 may be transverse to the second line 122.

In the third section 128, the first and second conductor portions 112*b* and 112*c* and the first and second conductor portions 114*b* and 114*c* may extend in the same relative positions along line 130 as along line 122 in the second section 120. As a result the broadside coupling and edge coupling of the conductor portions of the second section 120 may be maintained in the third section 128. The gap widths may vary or remain constant to provide the desired amount of edge coupling in the third section 128.

The planar transmission line 110 may also include a fourth section 132, with the third section 128 connected between the second section 120 and the fourth section 132. In the fourth section 132 a fourth conductor portion 112*e* of the conductor 112 may be disposed in the first plane and a fourth conductor portion 114*e* of the second planar conductor 114 may be disposed in the second plane.

In the fourth section 132, the conductor portion 112*e* and the conductor portion 114*e* may extend along a fourth line 134 as viewed normal to the planes of the conductors. The fourth line 134 may be transverse to the third line 130. In this example, line 134 is at a 45-degree angle to line 130, a 90-degree angle to line 122, and a 135-degree angle to line 117.

In the fourth section 132, the conductor portion 112*e* may have a broad surface facing a corresponding broad surface of the conductor portion 114*e* spaced apart by a separation width such that these conductor portions may be broadside coupled. The broad surfaces of the conductor portions 112*e* and 114*e* may be facing, overlapping, or completely overlapping in order to provide the desired amount of broadside coupling.

As shown in FIG. 7, the conductors may further include interconnects, such as vias 136, that interconnect conductor portions on different planes. More specifically, vias may interconnect the ends of the second conductor portion 114*b* of the conductor 114 respectively with the conductor portions 114*a* and 114*e* in the first and fourth sections. Vias may also interconnect the ends of the second conductor portion 112*b* of the conductor 112 respectively with the conduct portions 112*a* and 112*e* in the first and fourth sections.

Other forms of coupling may also be provided in the planar transmission line 110. For example, there may be conductor portions that provide increased capacitive coupling with ground planes, similar to transmission line 10 of FIGS. 1-4. In this example, conductive flags 112*f* and 114*f* laterally extend from second conductor portions 112*c* and 114*c* of the conductors 112 and 114 in the second section 120 and conductive flags 112*g* and 114*g* laterally extend from second portions 112*c* and 114*c* in the third section 128. Flags 112*f*, 114*f*, 112*g*, and 114*g* may variously provide coupling to another conductor, and/or to one or both of the ground planes. In this example, flags 112*f*, 114*f*, 112*g*, and 114*g* do not overlap with each other but rather are attached to different positions of the conductor portions they extend from so that they have little if any broadside coupling between them.

The planar transmission line 110 may also include multiple second conductor portions of the conductors 112 and 114 in the second section 120 and/or the third section 128 so that the portions alternate laterally across the section between conductors 112 and 114. Each of these additional second portions may have adjacent edges configured in such a way as to define additional gaps with widths that are sufficiently narrow as to edge couple the conductor portions. In other words, in addition to the second conductor portions 112*b*, 112*c*, 114*b*, and 114*c* extending along sections 120 and 128 as shown in FIG. 7, the planar transmission line 110 may also or may alternatively have at least one additional length of the planar conductors 112 and/or 114 extending along these sections to provide additional edge coupling between the conductors in the bend.

Additionally, the planar transmission line 110 may include additional sections between the first section 116 and the fourth section 132, such that the bend further approximates or is in the form of a curve and/or further bends the transmission line. It will be appreciated that other configurations may be realized for bends that are greater or less than the angles shown, with a number of intermediate sections, such as sections 120 and 128, as appropriate to provide for transmission line direction changes suitable for a particular application.

From the foregoing, it is seen that a planar transmission line may include first and second spaced apart planar conductors. The transmission line may include a first section in which the first and second conductors extend along a first line in respective first and second parallel planes and are broadside coupled. A second section may extend from the first section along a second line transverse to the first line. The first and second conductors in the second section may include respective first portions extending in the respective first and second planes that are broadside coupled. The first conductor may include a second portion in the second section extending in the second plane, with the first portion of the second conductor and the second portion of the first conductor having adjacent edges that are edge-coupled.

In some examples, the second conductor includes a second portion in the second section extending in the first plane, with the first portion of the first conductor and the second portion of the second conductor having adjacent edges that are edge-coupled.

The second section the first portion of the first conductor may be broadside coupled to the first portion of the second conductor and the second portion of the first conductor may be broadside coupled to the second portion of the second conductor.

The transmission line may include a third section with the second section connected between the first and third sections. In the third section the first conductor may extend in the first plane and the second conductor may extend in the second plane. The first and second conductors may also be broadside coupled in the third section. The third section may extend along a third line transverse to the second line.

The first and second portions of the first conductor and the first and second portions of the second conductor may extend from the second section into the third section.

The first and second portions of the first conductor and the first and second portions of the second conductor may extend in the same relative positions in the second and third sections.

Accordingly, this disclosure may disclose one or more independent or interdependent inventions directed to various combinations of features, functions, elements and/or properties, one or more of which may be defined in the following claims. Other combinations and sub-combinations of features, functions, elements and/or properties may be claimed later in this or a related application. Such variations, whether they are directed to different combinations or directed to the same combinations, whether different, broader, narrower or equal in scope, are also regarded as included within the subject matter of the present disclosure. An appreciation of the availability of protection for or significance of features, combinations or elements not presently claimed may not be presently realized. Accordingly, the foregoing embodiments are illustrative, and no single feature or element, or combination thereof, is essential to all possible combinations that may be claimed in this or a later application. Each claim defines an invention disclosed in the foregoing disclosure, but any one claim does not necessarily encompass all features or combinations that may be claimed.

Where the claims recite "a" or "a first" element or the equivalent thereof, such claims include one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

I claim:

1. A planar transmission line comprising first and second spaced apart planar conductors, the transmission line including a first section in which the first and second conductors extend along a first line and are broadside coupled, the first conductor extending along a first plane in the first section and the second conductor extending along a second plane in the first section, the second plane being parallel to the first plane, and a second section in which the first and second conductors extend along a second line transverse to the first line, the first and second conductors including respective first portions extending in the respective first and second planes that are broadside coupled, and the first conductor including a second portion extending in the second plane electrically in parallel with the first portion of the first conductor, with the first portion of the second conductor and the second portion of the first conductor having adjacent edges that are edge-coupled, the first conductor in the second section extending directly from the first conductor in the first section, the second conductor in the second section extending directly from the second conductor in the first section, the first and second portions of the first conductor extending directly from the first conductor in the first plane and extending in the second section, and the first portion of the second conductor extending directly from the second conductor in the second plane and extending in the second section.

2. The transmission line of claim 1, wherein the second conductor includes a second portion extending in the first plane electrically in parallel with the first portion of the second conductor, extending directly from the second conductor in the second plane, and extending in the second section, with the first portion of the first conductor and the second portion of the second conductor having adjacent edges that are edge-coupled.

3. The transmission line of claim 2, wherein in the second section the first portion of the first conductor is broadside coupled to the first portion of the second conductor and the second portion of the first conductor is broadside coupled to the second portion of the second conductor.

4. The transmission line of claim 2, further comprising a third section in which the first conductor extends in the first plane directly from the first and second portions of the first conductor in the second section and the second conductor extends in the second plane directly from the first and second portions of the second conductor in the second section, with the second section connected between the first and third sections, wherein the first and second conductors in the third section are broadside coupled.

5. The transmission line of claim 4, wherein the third section extends along a third line transverse to the second line.

6. The transmission line of claim 2, further comprising a third section in which the first and second conductors extend directly from the respective first and second conductors in the second section, with the second section connected between the first and third sections, wherein in the third section the first conductor extends in the second plane and the second conductor extends in the first plane and the first and second conductors are broadside coupled.

7. The transmission line of claim 6, wherein the third section extends along a third line transverse to the second line.

8. The transmission line of claim 2, further comprising a third section extending along a third line transverse to the second line, with the second section connected between the first and third sections, wherein the first and second portions of the first conductor and the first and second portions of the second conductor extend directly from the second section into the third section.

9. The transmission line of claim 8, wherein the first and second portions of the first conductor and the first and second portions of the second conductor extend in the same relative positions in the second and third sections.

10. The transmission line of claim 1, wherein the second section has a length and the second portion of the first conductor extends along the length of the second section.

11. A planar transmission line comprising first and second spaced apart planar conductors, the transmission line including a first section in which the first and second conductors extend along a first line and are broadside coupled, the first conductor extending along a first plane in the first section and the second conductor extending along a second plane in the first section, the second plane being parallel to the first plane, and a second section in which the first and second conductors extend along a second line transverse to the first line, the first conductor in the second section including first and second portions each extending directly from the first conductor in the first plane in the first section and extending along a common length in the second section, the first portion extending in the first plane and the second portion extending in the second plane, and the second conductor including a first portion extending in the second plane along the common length in the second section and extending directly from the second conductor in the second plane in the first section, with the first portions of the first and second conductors being broadside coupled along the common length in the second section, and the first portion of the second conductor and the second portion of the first conductor having adjacent edges that are edge-coupled.

12. The transmission line of claim 11, wherein the second conductor includes a second portion extending in the first plane, extending directly from the second conductor in second plane, and extending along the common length in the second section, with the first portion of the first conductor and the second portion of the second conductor having adjacent edges that are edge-coupled.

13. The transmission line of claim 12, wherein in the second section the second portion of the first conductor is broadside coupled to the second portion of the second conductor.

14. The transmission line of claim 12, further comprising a third section in which the first conductor extends in the first plane directly from the first and second portions of the first conductor in the second section and the second conductor extends in the second plane directly from the first and second portions of the second conductor in the second section, with the second section connected between the first and third sections, wherein in the first and second conductors in the third section are broadside coupled.

15. The transmission line of claim 14, wherein the third section extends along a third line transverse to the second line.

16. The transmission line of claim 12, further comprising a third section in which the first and second conductors extend directly from the respective first and second conductors in the second section, with the second section connected between the first and third sections, wherein in the third section the first conductor extends in the second plane and the second conductor extends in the first plane and the first and second conductors are broadside coupled.

17. The transmission line of claim 16, wherein the third section extends along a third line transverse to the second line.

18. The transmission line of claim 12, further comprising a third section extending along a third line transverse to the second line, with the second section connected between the first and third sections, wherein the first and second portions of the first conductor and the first and second portions of the second conductor extend directly from the second section into the third section.

19. The transmission line of claim 18, wherein the first and second portions of the first conductor and the first and second portions of the second conductor extend in the same relative positions in the second and third sections.

20. The transmission line of claim 11, wherein the second section has a length that is the same as the common length.

* * * * *